US005617659A

United States Patent [19]

Okubo

[11] Patent Number: 5,617,659

[45] Date of Patent: Apr. 8, 1997

[54] CONSTRUCTION MEMBER

[75] Inventor: Shiroshi Okubo, Suita, Japan

[73] Assignee: Monc Co., Ltd., Osaka, Japan

[21] Appl. No.: 492,447

[22] Filed: Jun. 19, 1995

[30] Foreign Application Priority Data

Jun. 22, 1994 [JP] Japan ..... 6-164627
Dec. 21, 1994 [JP] Japan ..... 6-336563

[51] Int. Cl.[6] ..... G09F 19/00

[52] U.S. Cl. ..... 40/545; 40/564; 362/147

[58] Field of Search ..... 40/545, 541, 564; 362/147, 806, 812

[56] References Cited

U.S. PATENT DOCUMENTS

| | | | |
|---|---|---|---|
| 2,141,207 | 12/1938 | Duntze | 40/545 |
| 2,202,396 | 5/1940 | Owen | 40/545 |
| 4,969,282 | 11/1990 | Eberhart | 40/545 |
| 5,446,634 | 8/1995 | Okubo | 362/806 X |

FOREIGN PATENT DOCUMENTS

| | | | |
|---|---|---|---|
| 2025461 | 3/1992 | Canada | 40/545 |

*Primary Examiner*—Kenneth J. Dorner
*Assistant Examiner*—Cassandra Davis
*Attorney, Agent, or Firm*—Armstrong, Westerman, Hattori, McLeland & Naughton

[57] ABSTRACT

A construction member includes a square frame. The frame is formed of a front frame and a back frame. A plate is secured to the inner side of an edge of the front frame. A glass tube constituting a visually perceptible part in the form of a letter or a pattern is secured to the back surface of the plate by an adhesive consisting of thermosetting resin having self-extinguish property. An electrode tube is formed at one end of the glass tube and the other end thereof. The glass tube encloses inert gas such as neon gas. A printed layer is formed on one main surface of the plate as another visually perceptible part by silk printing method or the like. The frame accommodates a reflective panel formed of stainless steel plate by spacing the reflective panel at a determined interval from the plate. A transformer for illuminating the glass tube is mounted on the back surface of the reflective panel.

12 Claims, 9 Drawing Sheets

FIG. 3
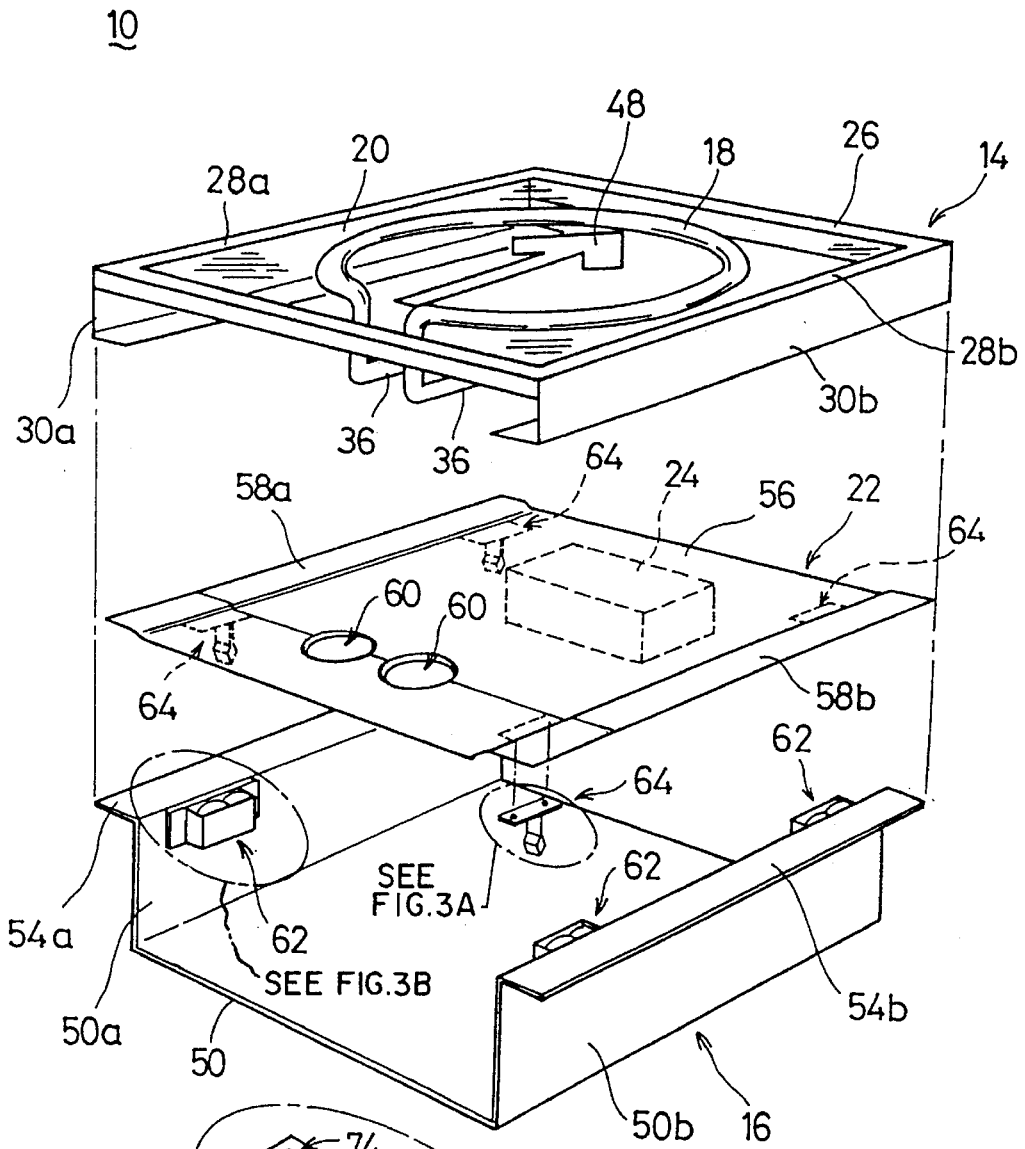
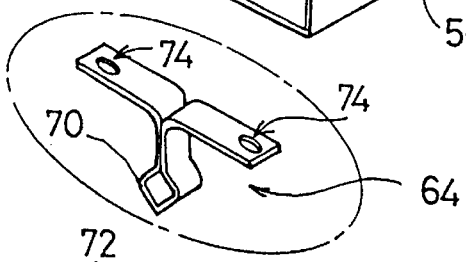
FIG. 3A
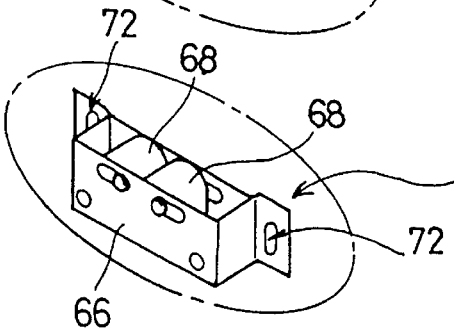
FIG. 3B

CONSTRUCTION MEMBER

BACKGROUND OF THE INVENTION

1. Field of the Invention

The present invention relates to a construction member, and more particularly, to a construction member used, for example, in floors, walls, ceilings, and the like, as an interior finish members and an exterior wall finish members for various kinds of buildings in, for example, commercial zones, leisure zones, resort facilities or the like.

2. Description of the Prior Art

Hitherto, construction members serving as an interior finish members and an exterior wall finish members included, among other things, woody boards, stone materials, gypsum boards, artificial stones, bricks, ceramic tiles, and plastic tiles and the like. Such conventional construction members, however, had their surfaces generally flat, and were lacking in general decorativeness. Only a few thereof were aesthetically variable.

The conventional construction members, in general therefore, could not meet the diverse needs of users as materials for buildings in, for example, city zones and commercial zones; or those in play zones, such as theme parks, waterfront constructions, and various resort facilities; or as formative materials for enhancing visual effects for various events; and interior finishes.

In the prior art which makes the background of the present invention, there is a neon tube used, for example, in signboards or neon sign, and the like. In a conventional neon tube itself is constituted as a visually perceptible part for indicating a letter, a symbol or a pattern by merely bending the neon tube itself. FIG. 10 is a perspective view showing a conventional neon sign which forms the background of the present invention.

A neon sign 1 includes a rectangular supporting plate 2 made of metal. A neon tube 3 forms the indication of a letter "OPEN" on the surface of the supporting plate 2. The neon tube 3 is fixed to the supporting plate 2 by means of a supporter 4. The supporter 4 includes a column-shaped supporting leg 5. An approximately U-shaped holding member 6 made of an elastic metal such as spring steels is formed on one end of the supporting leg 5 in the axial direction thereof. The holding member 6 is energized so that it is closed in the radial direction thereof. An mounting strip 8 having a mounting screw 7 is formed on the other end of the supporting leg 5 in the axial direction thereof. The supporter 4 is installed on the supporting plate 2 appropriately by means of the mounting screw 7. The neon tube 3 is held on the supporting plate 2 by the holding portion 6 so as to prevent the neon tube 3 from being dropped.

In the conventional neon sign shown in FIG. 10, the neon tube 3 constituting the visually perceptible part is supported partly by the holding portion 6 of the supporter 4. Thus, the neon sign is unstable. Further, because the neon tube 3 itself is exposed to the outside, there is a possibility that it is damaged by shock applied thereto from outside.

SUMMARY OF THE INVENTION

It is, therefore, a primary object of the present invention to provide a construction member which is capable of supporting and protecting a visually perceptible part and serves as a new formative material, that is rich in decorativeness, as well as in producing visual effect.

The present invention is directed to a construction member comprising a frame; a glass tube constituting a visually perceptible part in the form of a letter, a symbol or a pattern and filling inert gas; and means for illuminating the glass tube. The glass tube is supported with a surface of the plate by the glass tube being secured to one main surface of the plate.

Preferably, the plate is made of a glass material and secured to one main surface of the plate by means of a material consisting of thermosetting resin, such as thermosetting adhesive.

The construction member may be formed a printed layer which constitutes another visually perceptible part in the form of, for example, a letter, a symbol or a pattern, or the like, on the other main surface of the plate. The construction member may be disposed a reflective panel for reflecting light transmitted from the glass tube inside the frame at a spaced distance from the plate.

A protection layer consisting of thermosetting resin may be formed entirely on one main surface of the plate in such a manner that the protection layer covers the glass tube.

The construction member may be formed the frame which constitutes a front frame provided on the side of the other main surface of the plate; and a back frame which is disposed in the side of one main surface of the plate and removably installed within the reflective panel by means of engaging means.

The glass tube which constitutes the visually perceptible part in the form of a letter, a symbol or a pattern is secured to one main surface of the plate. That is, because the glass tube is supported on one main surface of the plate, the glass tube contacts it in a larger area, compared with the conventional construction comprising the supporter which supports the glass tube such as a neon tube. That is, the glass tube is supported on the plate by more supporting points, compared with the conventional construction. Therefore, the glass tube can be supported stably.

The glass tube which constitutes the visually perceptible part in the form of a letter, a symbol or a pattern is illuminated by means for illuminating. That is, the visually perceptible part is created by means of an illuminating means and a letter, a symbol or a pattern, or the like, in the visually perceptible part is illuminated by means of the emitting means.

The printed layer formed on the other main surface of the plate constitutes another visually perceptible part in the form of a letter, symbol or pattern on the plate. The reflective panel disposed within the frame reflects thereon the letter, symbol or pattern of the visually perceptible part illuminated by means of the emitting means.

The protection layer consisting of thermosetting resin formed on the entirety of one main surface of the plate protects the entire glass tube.

The engaging means removably engages the reflective panel with the back frame.

According to the present invention, a novel construction member which is capable of supporting and protecting a visually perceptible part is obtainable, and besides a novel construction member as a new formative material with good decorativeness and excellent in producing visual effects is obtainable. That is, because the glass tube which constitutes the visually perceptible part in the form of a letter, a symbol or a pattern is secured to one main surface of the plate so as to support the glass tube stably on the plate. Therefore, the glass tube is resistant to external shocks or vibrations and is damaged in a small degree in transportation or an installing operation. Further, the structure of the construction member eliminates the need for the provision of the glass tube-supporter. Thus, the glass tube can be easily handled.

Furthermore, because the glass tube is illuminated by the emitting means, the glass tube is able to form a visually perceptible part in the form of a letter, a symbol or a pattern, or the like, with good decorativeness.

Further, because the entire glass tube is protected by the protection layer, the visually perceptible part is very durable.

In addition, the printed layer is formed as another visually perceptible part on the other main surface of the plate. Thus, when the glass tube is illuminated, the printed layer is dark, whereas when the glass tube is not illuminated, the printed layer can be visualized clearly. Accordingly, the formative effect of the construction member can be enhanced greatly owing to the synergetic effects produced by the contrast between the illumination of the glass tube and the visually perceptible part in the form of the printed layer.

Moreover, an image of the glass tube illuminated by the emitting means is reflected on the front surface of the reflective panel provided inside the frame. Consequently, the visually perceptible part looks deep and extensive.

That is to say, the visually perceptible part is created by means of an illuminating means and a letter, symbol, pattern, or the like, in the visually perceptible part is illuminated by means of the emitting means and is reflected on the surface of the reflective panel.

Hence, with this kind of construction member a three-dimensional image, rich in the sense of depth, can be produced through overlapping of the visually perceptible part.

Further, the frame is constituted of the front frame and the back frame on which the reflective panel can be removably installed by means of the engaging means. Therefore, the construction member can be easily installed, for example, in floors, walls, ceilings, and the like. In this case, first, the back frame is mounted on a desired position. Then, the reflective panel is mounted on the back frame with a single operation by means of the engaging means. The front frame is then installed on the back frame.

The above and other objects, features, aspects, and advantages of the present invention will become more apparent from the following detailed description made with reference to the drawings.

BRIEF DESCRIPTION OF THE DRAWINGS

FIG. 3 is an exploded perspective view of the construction member shown in FIGS. 1 and 2.

FIGS. 5(A) and 5(B) are perspective views showing the process for manufacturing the construction member shown in FIGS. 1, 2 and 3, in which FIG. 5(A) is a perspective view showing a prepared plate; and FIG. 5(B) is a perspective view showing a state in which printing has been made on a surface of the plate.

FIGS. 6(A) and 6(B) are perspective views showing the process for manufacturing the construction member shown in FIGS. 1, 2 and 3, in which FIG. 6(A) is a perspective view showing a state in which an electrode tube having a glass tube mounted thereon is installed on the back surface of the plate; and FIG. 6(B) is a perspective view showing a state in which adhesive is applied to the entire back surface of the plate from above the glass tube.

FIGS. 7(A) and 7(B) are perspective views showing the process for manufacturing the construction member shown in FIGS. 1, 2 and 3, in which FIG. 7(A) is a perspective view showing a state in which the glass tube is pressed against the back surface of the plate by using a pressing case so as to secure the glass tube to the plate; and FIG. 7(B) is a sectional view taken on line VIIB—VIIB of FIG. 7(A).

DESCRIPTION OF THE PREFERRED EMBODIMENTS

Figure 1:
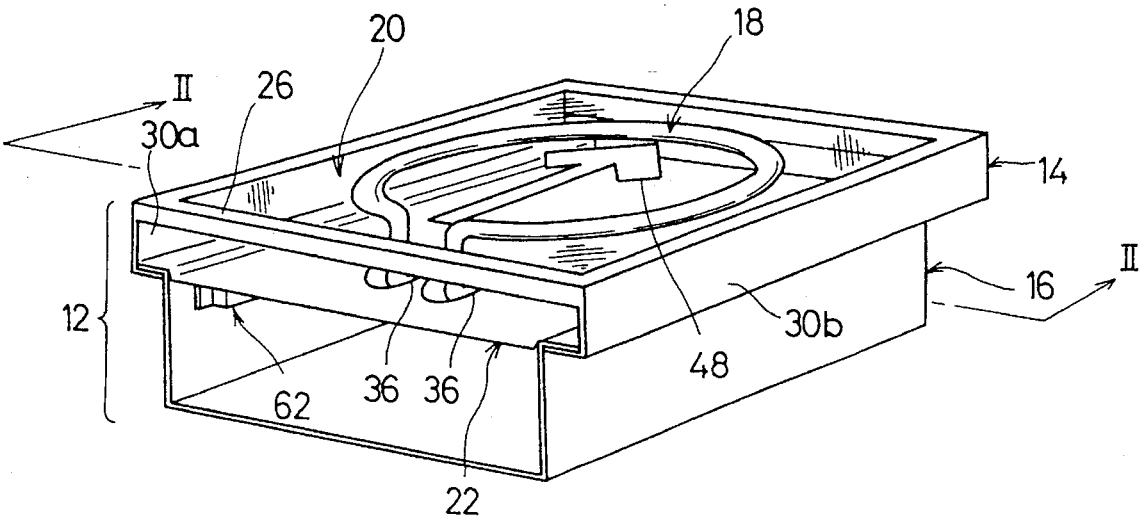
FIG. 1 is a perspective view showing an embodiment of the present invention.
Figure 2:
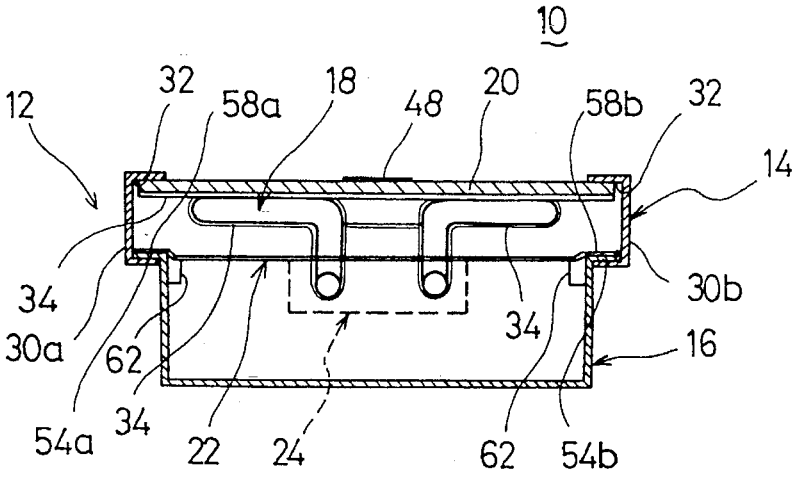
FIG. 2 is a sectional view taken on line II—II in FIG. 1.

FIG. 1 is a perspective view showing an embodiment of the present invention. FIG. 2 is a sectional view taken on line II—II of FIG. 1. FIG. 3 is an exploded perspective view showing of the construction member shown in FIGS. 1 and 2.

A construction member 10 includes a frame 12. The frame 12 is formed of a front frame 14 and a back frame 16. Disposed in the frame 12 are a glass tube 18 constituting a visually perceptible part; a plate 20 supporting the glass tube 18 on its one main surface; a reflective panel 22 removably attached on the back frame 16 and spaced at a distance from the glass tube 18; a transformer 24 attached on the reflective panel 22, for applying a voltage to the glass tube 18.

That is, the front frame 14 includes a base frame 26, the plan configuration of which is square and the sectional configuration of which is "equal angle steel"-shaped. Plate-shaped side strips 30*a* and 30*b* both L-shaped in section extend from a side 28*a* of the base frame 26 and from a side 28*b* opposed to the side 28*a*, respectively. The base frame 26, the side strip 30*a*, and the side strip 30*b* all made of a metallic material such as stainless steel are formed integrally with each other.

On the inside of the front frame 14, the glass tube 18 which constitutes the visually perceptible part in the form of a letter, a symbol, a design, a pattern, or the like are disposed. The glass tube 18 is formed of tempered glass or the like. The tempered glass is bent into a desired configuration by bending processing to form the glass tube 18. An inert gas such as neon, helium or argon is filled in the glass tube 18. In this embodiment, the tempered glass is bent into the O-shaped glass tube 18, and neon gas is filled in the glass tube 18.

The glass tube 18 is supported by the transparent or semitransparent plate 20 made of glass such as borosilicate glass, tempered glass or the like. The plate 20 having a square configuration is secured to the inner side of an edge 32 of the front frame 14. The plate 20 is secured to the front frame 14 with adhesive consisting of thermosetting resin such as epoxy resin. The glass tube 18 is secured to the back surface of the plate 20 with adhesive consisting of thermosetting resin such as epoxy resin.

In this embodiment, adhesive consisting of thermosetting resin such as epoxy resin having self-extinguish property is applied to the periphery of the glass tube 18 and to the entire back surface of the plate 20. That is, a resin layer 34 consisting of the thermosetting resin having self-extinguish is formed on the entire back surface of the plate 20 in such a manner that the glass tube 18 is covered with the thermosetting resin. The resin layer 34 allows the glass tube 18 to be secured to the back surface of the plate 20 and serves as a protection layer for protecting the glass tube 18.

Figure 4:
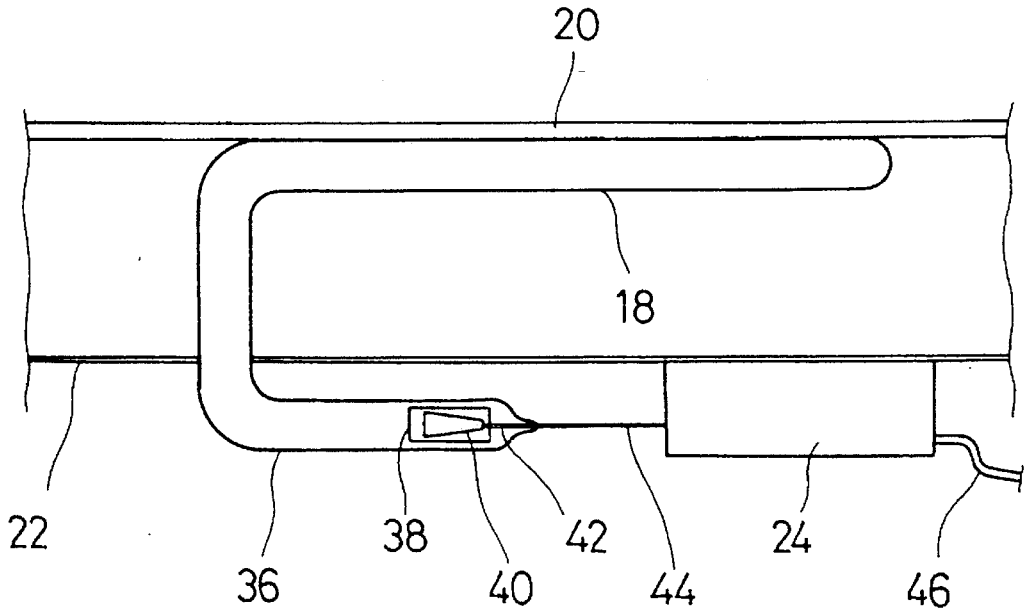
FIG. 4 is a side view showing an electrode tube and its periphery.

An electrode tubes 36, 36 having a cylindrical configuration is formed of glass or the like are formed on one end portion and the other end portion of the glass tube 18. Referring to FIG. 4, A holding tube 38 having an approximately cylindrical configuration is disposed inside each electrode tube 36. An electrode 40 having a cylindrical and approximately conic is disposed in the holding tube 38. The electrode 40 is formed of metal such as iron or copper. One end, of the electrode 40, in the axial direction thereof is connected with a lead-in wire 42. The lead-in wire 42 is connected with a insulating coating wire 44 connected with the transformer 24. The transformer 24 is connected with an external power source (not shown) with a cord 46, thus a voltage is applied between the electrodes 40 and 40 of the electrode tubes 36 and 36. As a result, discharge phenomenon takes inside the glass tube 18 as a discharge pass and consequently, the glass tube 18 illuminates.

In this embodiment, the transformer 24 has a low voltage and is hence safe, unlike a transformer having a high voltage for use in a conventional signboard or neon sign.

A printed layer 48 constituting another visually perceptible part in the form of a letter, a symbol, a design or a pattern is formed on the front surface of the plate 20 by screen printing method or offset printing method. In this embodiment, the printed layer 48 is colored and arrow-shaped.

The back frame 16 is mounted on the front frame 14. The back frame 16 includes a U-shaped back plate 50. Rectangular projection strips 54*a* and 54*b* extend from short-side portions 50*a* and 50*b* of the back plate 50, respectively. The projection strips 54*a* and 54*b* are projected outward from the short-side portions 50*a* and 50*b* of the back plate 50, respectively. The back plate 50, the short-side portions 50*a* and 50*b*, and the projection strips 54*a* and 54*b* all made of a metallic material such as stainless steel are formed integrally with each other.

The reflective panel 22 is disposed inside the frame 12 by spacing it at a predetermined interval from the back surface of the plate 20. The reflective panel 22 is for reflecting light transmitted from the glass tube 18, when the glass tube 18 is illuminated.

The reflective panel 22 includes a square reflective portion 56 made of metal such as stainless steel. Mounting strips 58*a* and 58*b* having a belt-like configuration are formed on both sides in the widthwise direction of the reflective portion 56. The reflective portion 56 and the mounting strips 58*a*, 58*b* are formed integrally with each other. Two circular through-holes 60 and 60 are formed on main surface of the reflective portion 56. In installing the reflective panel 22 inside the frame 12, one end portion and the other end portion of the glass tube 18 and the electrode tubes 36 and 36 are inserted through the through-holes 60 and 60. The transformer 24 is mounted on the back surface of the reflective panel 22. It is preferable that the front surface of the reflective portion 56 is polished to mirror-like surface finish.

The reflective panel 22 is removably installed on the back frame 16 by an engaging means. More specifically, four receiving members 62 serving as one engaging means are mounted on the back frame 16, and insertion members 64 serving as the other engaging means and removably engaging the receiving members 62 are mounted on the reflective panel 22. In this case, two receiving members 62 spaced at a predetermined interval are mounted on the short-side portions 52*a* and 52*b* of the back frame 16, respectively in the lengthwise direction thereof. In correspondence to the positions of the receiving members 62, two insertion members 64 spaced at a predetermined interval are mounted on the mounting strips 58*a* and 58*b* of the reflective panel 22, respectively in the lengthwise direction thereof.

Referring to FIG. 3, each receiving member 62 includes an approximately U-shaped mounting metal fixture 66 made of steel and serving as an accommodating frame. Each mounting metal fixture 66 disposes two rollers 68 and 68 made of nylon resin or the like and positioned in close proximity to each other. Each receiving member 62 is fixed to the back frame 16 by a fixing means such as screws via holes 72 formed on the mounting metal fixture 66.

A projection 70 of each insertion member 64 made of steel and approximately T-shaped is removably inserted between the rollers 68 and 68 of each receiving member 62. Each insertion member 64 is secured to the reflective panel 22 by means of screws or the like via mounting holes 74.

Thus, the reflective panel 22 can be removably installed on the back frame 16 with relative ease.

In this embodiment, the reflective panel 22 is made of stainless steel but may be made of metals other than stainless steel or of a semi-transparent mirror. Further, the reflective panel 22 may be formed by attaching a reflective sheet to one main surface of a square partitioning plate made of metal or synthetic resin. In this case, the reflective sheet is made of, for example, an aluminum foil or a resin film reflecting light such as polyethylene, polypropylene or the like.

The method for manufacturing the construction member 10 shown in FIGS. 1, 2 and 3 is described below with reference to FIGS. 2, 3, 5, 6, 7 and 8.

Figure 5A:
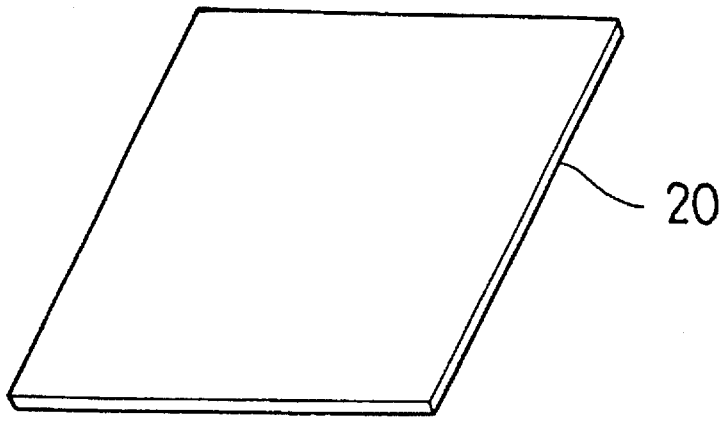

First, a transparent or semitransparent plate made of glass such as boro-silicate glass or tempered glass is prepared. Then, the plate is cut to a predetermined configuration and size to form the plate 20, as shown in FIG. 5(A).

Figure 5B:
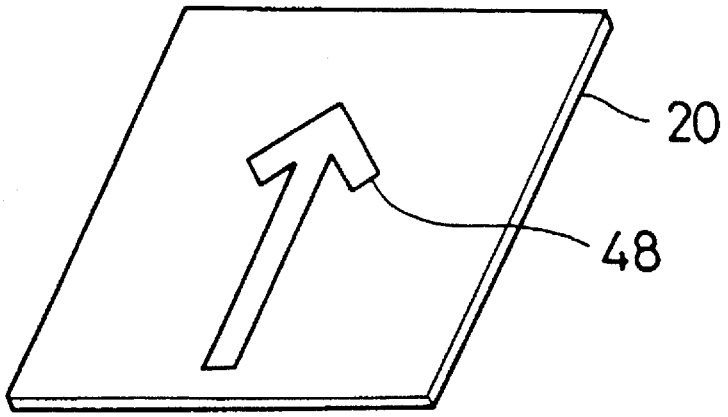

Then, as shown in FIG. 5(B), the printed layer 48 which shows a colored and arrow-shaped pattern is formed on the surface of the plate 20 by silk screen printing method or offset printing method.

Figure 6A:
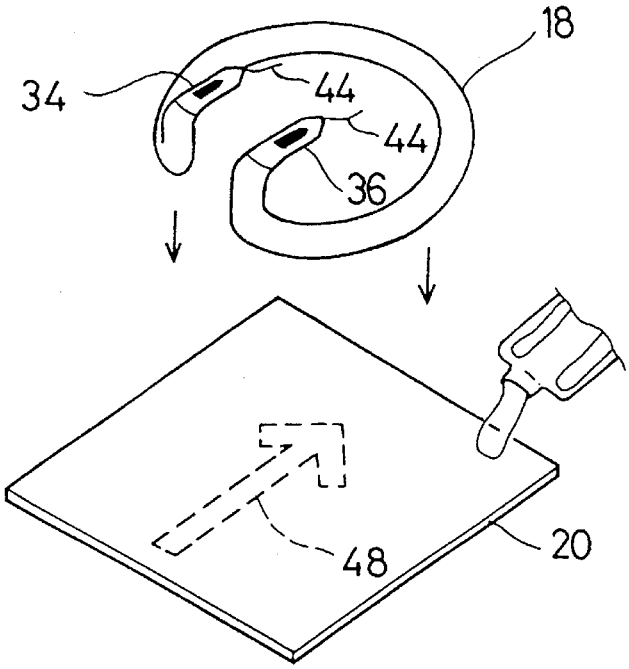
Figure 6B:
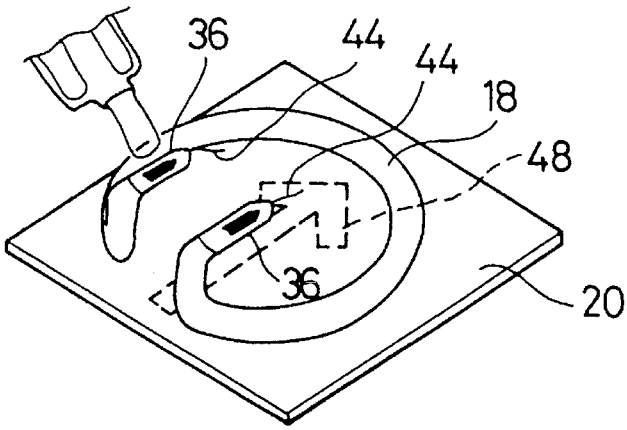

The glass tube 18 made of tempered glass bent in the configuration of a letter "O" is prepared. The electrode tubes 36 and 36 are installed on one end the other end of the glass tube 18, and then, inert gas such as neon, helium or argon is filled in the glass tube 18. As shown in FIG. 6(A), an adhesive consisting of thermosetting resin such as epoxy resin is applied to the entire back surface of the plate 20.

Thereafter, the glass tube 18 is mounted on the back surface of the plate 20. Then, the adhesive consisting of epoxy resin is uniformly applied to the periphery of the glass tube 18 and the back surface of the plate 20 to form the resin layer 34 on the entire back surface of the plate 20 in such a manner that the glass tube 18 is covered with the adhesive, as shown in FIG. 2.

Figure 7A:
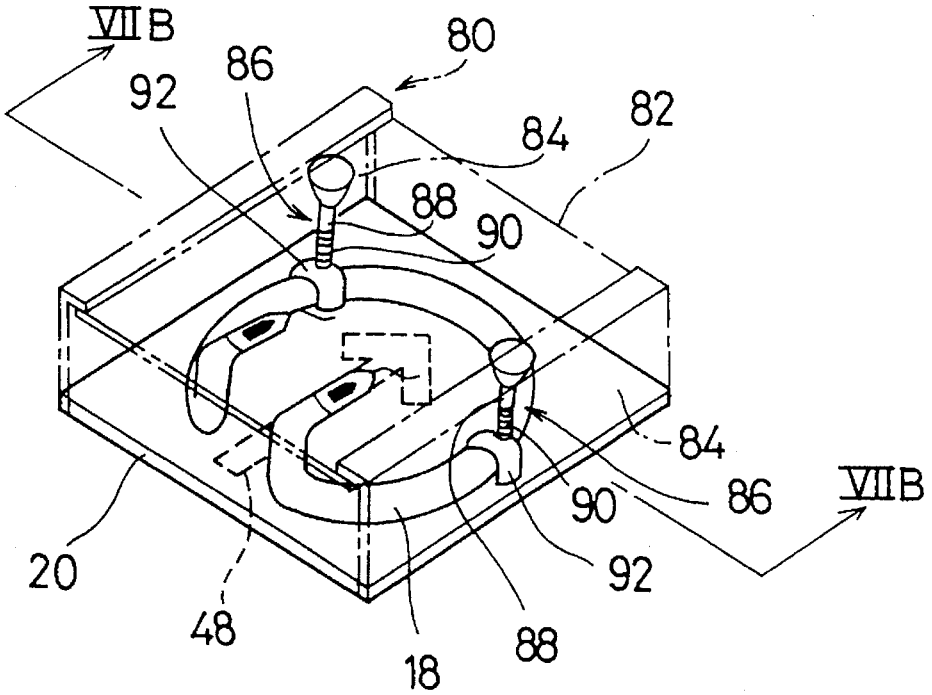
Figure 7B:
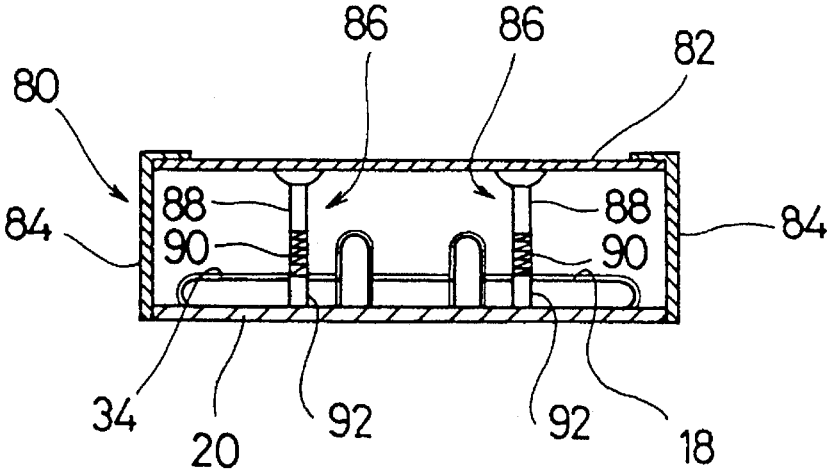

As shown in FIGS. 7(A) and 7(B), the glass tube 18 temporarily attached to the back surface of the plate 20 is pressed against the plate 20 by a pressing case 80. As a result, the glass tube 18 is firmly fixed to the plate 20. The pressing case 80 includes a square pressing plate 82. Both sides of the pressing plate 82 are supported by a plurality of L-shaped side legs 84. A plurality of pressing legs 86 is mounted on the inner surface of the pressing plate 82. Each pressing leg 86 includes a bar-shaped portion 88. A pressing portion 92 approximately semicircular in section is formed on the leading end of the bar-shaped portion 88. The pressing portion 92 is energized by an energying member 90 such as a spring in the axial direction of the bar-shaped portion 88.

That is, the glass tube 18 temporarily attached to the back surface of the plate 20 is uniformly pressed against the plate 20 by the pressing portion 92 of each pressing leg 86, and then, left at the room temperature or at a low temperature for a predetermined period of time. In this embodiment, the glass tube 18 is left for 10–12 hours at the room temperature. Then, the pressing plate 82, the side legs 84, and the pressing legs 86 are removed. In this manner, the glass tube 18 is firmly secured to the back surface of the plate 20.

Figure 8:
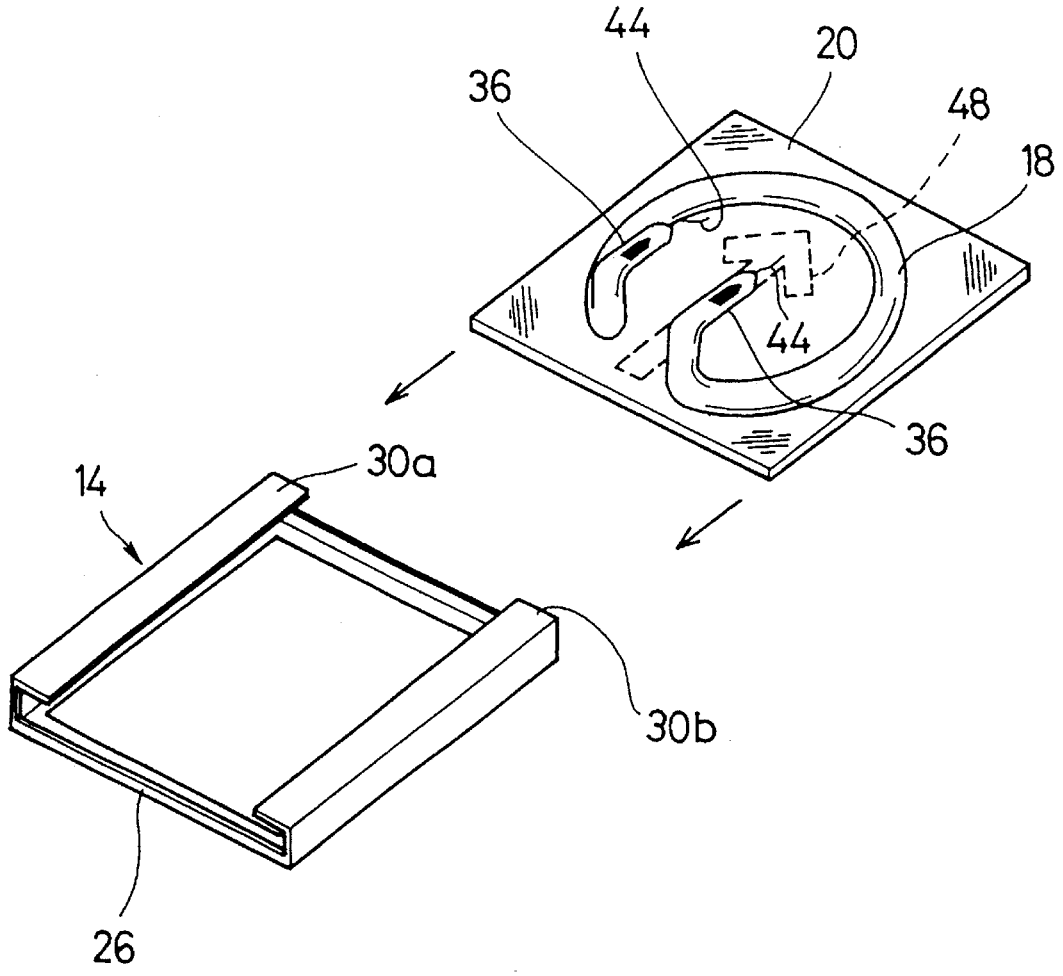
FIG. 8 is a perspective view showing a state in which the plate to which the glass tube has been fixed is inserted into U-shaped portions of a front frame.

Thereafter, as shown in FIG. 8, the plate 20 to which the glass tube 18 has been fixed is inserted into the inner side of the edge 32 of the front frame 14, with the glass tube 18 located below the plate 20. As shown in FIG. 2, both sides of the plate 20 are fixed to the inner side of the edge 32 of the front frame 14, for example, by means of adhesive consisting of epoxy resin.

The reflective panel 22 is installed on the back frame 16 by means of the engaging means 62 and 64. The projection strips **54*a* and 54*b* of the back frame 16 to which the reflective panel 22 has been installed are secured to the shorter sides of the side strips 30*a* and 30*b* of the front frame 14 by means of the adhesive agent consisting of epoxy resin. In this manner, the construction member 10** is manufactured.

Figure 9A:
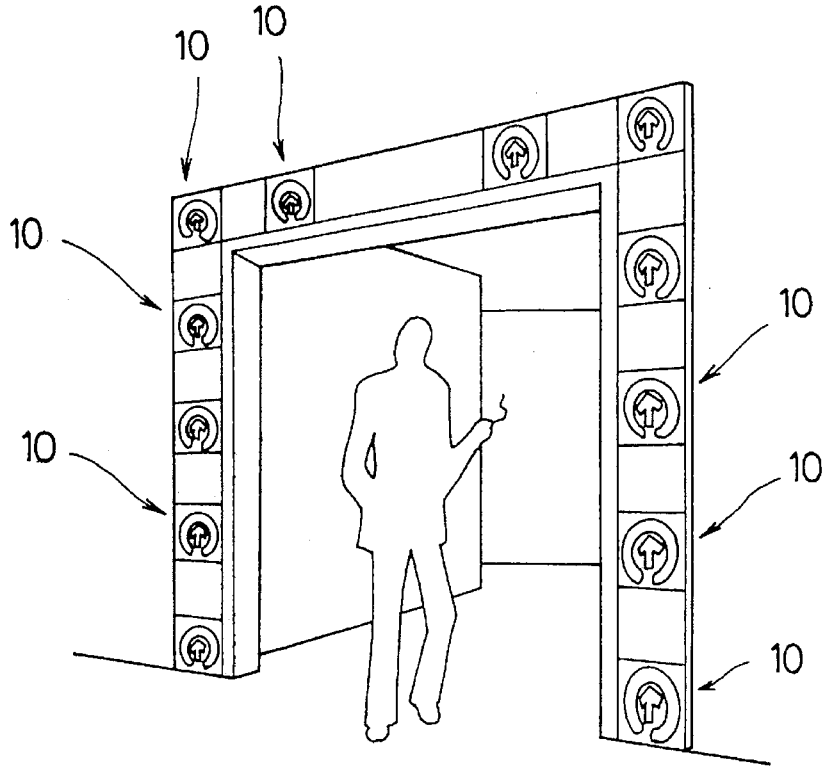
FIG. 9(A) is a perspective view showing an example of the use of the construction member shown in FIGS. 1, 2 and 3.
Figure 9B:
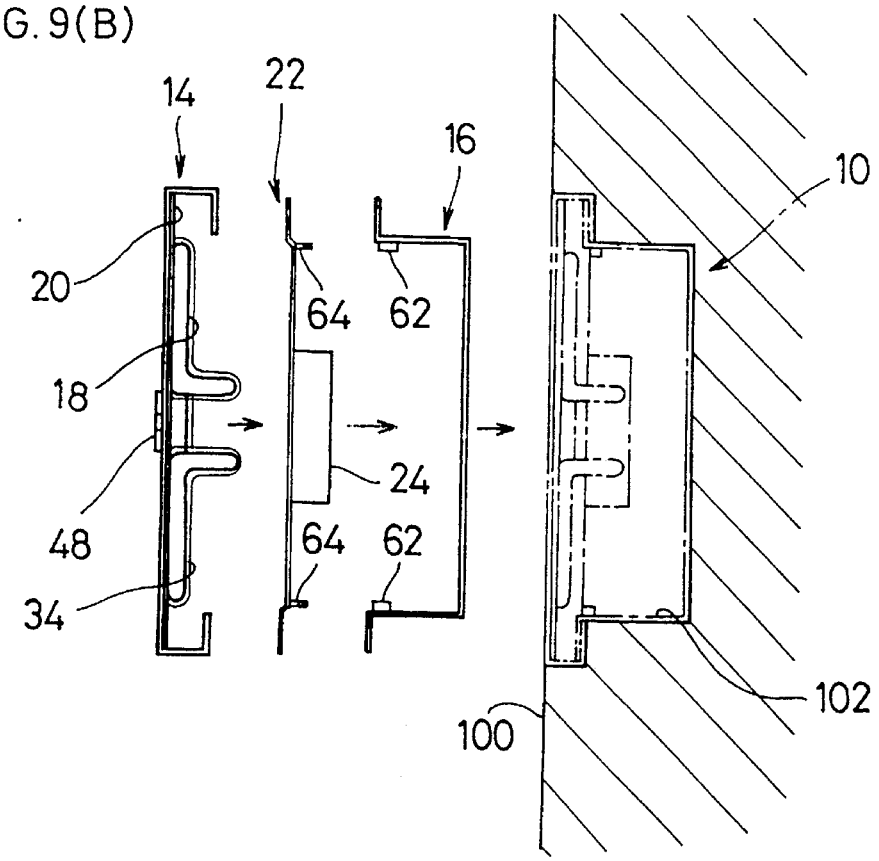
FIG. 9(B) is a side view showing the process of mounting the construction member on a wall.

FIG. 9(A) is a perspective view showing an example of the use of the construction member 10 shown in FIGS. 1, 2 and 3. FIG. 9(B) is a side view showing the process of mounting the construction member on a wall.

In the use example, the construction member 10 is mounted on a wall as a formative material to enhance the formative effect of, for example, a pavilion of an exhibition. In this case, as shown in FIG. 9(B), a space for accommodating the construction member 10 is provided at a desired position of a wall surface 100. That is, an accommodating hole 102 having a configuration similar to that of the construction member 10 and greater than the construction member 10 is formed at a predetermined position of the wall surface 100. Then, the back frame 16 of the construction member 10 is secured to the accommodating hole 102 by means of screws or the like. The reflective panel 22 is then removably installed on the back frame 16 by means of the engaging means 62 and 64. Thereafter, the front frame 14 is mounted on the front surface side of the reflective pane 122.

Figure 10:
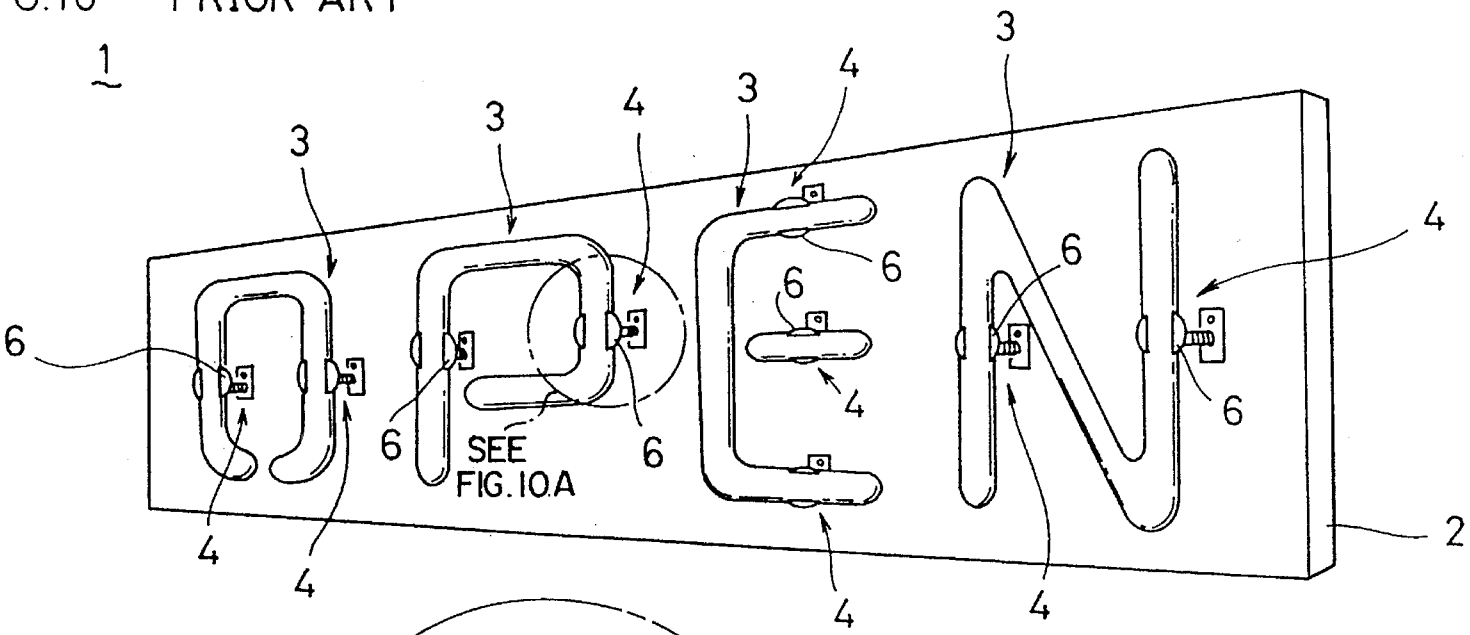
FIG.10 PRIOR ART
FIG. 10 is a perspective view showing a conventional neon sign which forms the background of the present invention.
Figure 10A:
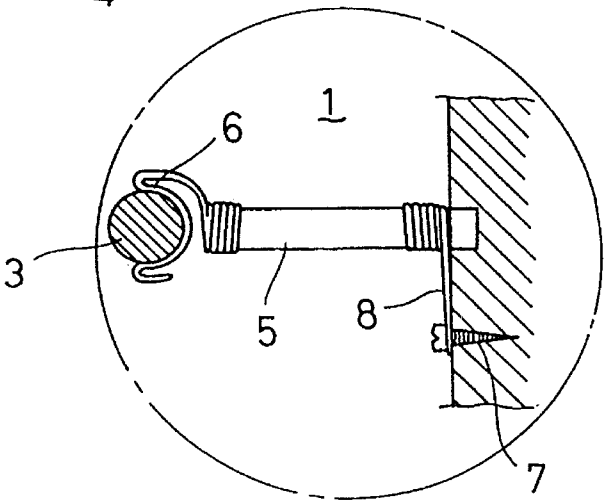
FIG. 10A PRIOR ART

In the construction member 10 according to the present invention, because the glass tube 18 constituting the visually perceptible part in the form of a letter, a symbol, a design or a pattern is secured to the back surface of the plate 20, the glass tube 18 is reliably supported on the back surface of the plate 20. Therefore, unlike the conventional glass tube-supporting construction comprising the supporter 3 as shown in FIG. 10, the glass tube 18 is resistant to external shocks or vibrations and damaged in a smaller degree in transportation or an installing operation. Further, the construction member 10 has no need of the supporter 3 for supporting the glass tube in comparison with conventional neon sign. Thus, the glass tube 18 can be easily handled.

Furthermore, because the glass tube 18 is illuminated by means for illuminating, the glass tube 18 is able to form a visually perceptible part in the form of a letter, a symbol or a pattern, or the like, with good decorativeness. In addition, the printed layer 48 is formed as another visually perceptible part on the front surface of the plate 20. Thus, when the glass tube 18 is illuminated, the printed layer 48 is dark, whereas when the glass tube 18 is not illuminated, the printed layer 48 can be indicated clearly. Accordingly, the formative effect of the construction member 10 can be enhanced owing to the synergetic effect produced by the contrast between the illumination of the glass tube 18 and the display of the printed layer 48. Moreover, an image of the glass tube 18 illuminated by the means for illuminating is reflected on the front surface of the reflective panel 22 provided inside the frame 12. Consequently, with this kind of construction member a three-dimensional image, rich in the sense of depth, can be produced through overlapping of the visually perceptible part.

That is, in the construction member 10 according to the present invention, there is able to provide a novel construction member which is capable of supporting and protecting a visually perceptible part. Furthermore, a novel construction member as a new formative material with good decorativeness and excellent in producing visual effects is obtainable.

Further, in the construction member 10, the reflective panel 22 can be removably installed on the back frame 16 by the receiving member 62 and the insertion members 64 both constituting the engaging means. Therefore, the construction member 10 can be easily installed, for example, in floors, walls, ceilings, and the like.

Furthermore, the construction members 10 according to the present invention may be used in combination for any desired pattern. In such case, it is also possible to turn the light in the glass tube 18 on and off by providing the switch for such construction member 10 with a controller, or the like, thus creating light-flowing effects, even changing the color of light and bringing about effective visual effects rich in variation.

Further, when the construction member 10 according to the present invention is properly water-proof treated, such construction member 10 may possibly be used as a bathtub lid or a bathtub flooring.

In the above embodiment, the plate 20 is made of borosilicate glass, tempered glass or the like. But in addition, the plate 20 may be made of synthetic resin such as polyacrylate (acrylic resin), polymethyl methacrylate, acrylonitrile-butadiene-styrene (ABS) or polycarbonate. Further, the plate 20 may be made of metal material such as aluminum or stainless steel or a woody material.

While the present invention has been particularly described and shown, it is to be understood that such description is used merely as an illustration and example rather than limitation, and the spirit and scope of the present invention are determined solely by the terms of the appended claims.

What is claimed is:

1. A construction member comprising:

a frame;

a plate having a front surface and a back surface and disposed in said frame;

a glass tube having a visually perceptible indicia and being filled with inert gas;

means for illuminating said glass tube; and a reflective panel, for reflecting light transmitted from said glass tube, disposed in said frame at a spaced distance from said plate and said glass tube, wherein said glass tube is supported with said back surface of said plate by said glass tube being secured to said back surface of said plate.

2. The construction member according to claim 1, further comprising a primed layer formed on said front surface of said plate and having another visually perceptible indicia.

3. The construction member according to claim 1, further comprising a front frame disposed on a side of said front surface of said plate; and a back frame disposed on a side of said back surface of said plate and removably mounted to said reflective panel by means of engaging means.

4. The construction member according to claim 2, further comprising a front frame disposed on a side of said front surface of said plate; and a back frame disposed on a side of said back surface of said plate and removably mounted to said reflective panel by means of engaging means.

5. The construction member according to claim 1, wherein said plate is made of a glass material; and said glass tube is secured to said back surface of said plate by means of thermosetting resin.

6. The construction member according to claim 2, wherein said plate is made of a glass material; and said glass tube is secured to said back surface of said plate by means of thermosetting resin.

7. The construction member according to claim 3, wherein said plate is made of a glass material; and said glass tube is secured to said back surface of said plate by means of thermosetting resin.

8. The construction member according to claim 4, wherein said plate is made of a glass material; and said glass tube is secured to said back surface of said plate by means of thermosetting resin.

9. The construction member according to claim 1, wherein a protection layer consisting of thermosetting resin is formed on the entirety of said back surface of said plate in such a manner that said protection layer covers said glass tube.

10. The construction member according to claim 2, wherein a protection layer consisting of thermosetting resin is formed on the entirety of said back surface of said plate in such a manner that said protection layer covers said glass tube.

11. The construction member according to claim 3, wherein a protection layer consisting of thermosetting resin is formed on the entirety of said back surface of said plate in such a manner that said protection layer covers said glass tube.

12. The construction member according to claim 4, wherein a protection layer consisting of thermosetting resin is formed on the entirety of said back surface of said plate in such a manner that said protection layer covers said glass tube.

* * * * *